United States Patent [19]

Soroka et al.

[11] Patent Number: 4,465,188

[45] Date of Patent: Aug. 14, 1984

[54] INFLATABLE PACKAGING STRUCTURE

[75] Inventors: Walter G. Soroka; Michael P. Galda, both of Mississauga, Canada

[73] Assignee: Barbecon Inc., Toronto, Canada

[21] Appl. No.: 418,687

[22] Filed: Sep. 16, 1982

[30] Foreign Application Priority Data

Jul. 2, 1982 [CA] Canada ..... 406823

[51] Int. Cl.[3] ..... B65D 81/02; B65D 81/14; B65D 30/24

[52] U.S. Cl. ..... 206/522; 206/521; 383/3; 383/38; 383/904

[58] Field of Search ..... 206/521, 522; 5/441, 5/442, 449; 229/62.5; 150/9; 383/3, 38, 904

[56] References Cited

U.S. PATENT DOCUMENTS

| | | | |
|---|---|---|---|
| 1,457,496 | 6/1923 | Butler . | |
| 2,681,142 | 6/1954 | Cohen . | |
| 2,774,503 | 12/1956 | Moore . | |
| 3,098,563 | 7/1963 | Skees | 206/522 |
| 3,138,248 | 6/1964 | Abbott . | |
| 3,207,420 | 9/1965 | Nararrete-Kindelan | 229/56 |
| 3,319,685 | 5/1967 | Urban | 206/373 |
| 3,340,669 | 9/1967 | Farquharson | 53/455 |
| 3,346,101 | 10/1967 | Pestka | 206/522 |
| 3,398,501 | 8/1968 | Aninger | 53/474 |
| 3,889,743 | 6/1975 | Presnick | 206/522 |
| 4,155,453 | 5/1979 | Ono | 206/522 |
| 4,184,596 | 1/1980 | Avery | 206/522 |
| 4,235,065 | 11/1980 | Freeman | 53/472 |
| 4,240,556 | 10/1980 | Field | 206/522 |

FOREIGN PATENT DOCUMENTS

| | | | |
|---|---|---|---|
| 152980 | 1/1914 | Canada . | |
| 724014 | 12/1965 | Canada . | |
| 816532 | 7/1969 | Canada . | |
| 2544156 | 4/1977 | Fed. Rep. of Germany | 206/521 |
| 1472870 | 1/1967 | France | 206/522 |
| 1603275 | 2/1972 | France | 206/522 |
| 848248 | 9/1960 | United Kingdom | 206/522 |
| 1394877 | 5/1975 | United Kingdom | 206/522 |

*Primary Examiner*—William T. Dixson, Jr.
*Assistant Examiner*—Brenda J. Ehrhardt
*Attorney, Agent, or Firm*—Ridout & Maybee

[57] ABSTRACT

To provide improved protection for a fragile or delicate article in the event that an inflated packaging structure in which the article is disposed for transportation is punctured there is provided a light weight, simple and inexpensive inflatable packaging structure in which an inflatable inner liner attached within an outer envelope comprises two inflatable zones each incorporating a plurality of inflatable cells, with the cells of one of the zones alternating with the cells of the other zone. Thus, with the inner liner inflated and the fragile or delicate article disposed between two superposed layers of the liner the article is still substantially protected by the inflated cells of one of the zones even if the other zone is punctured.

9 Claims, 2 Drawing Figures

INFLATABLE PACKAGING STRUCTURE

This invention is concerned with an inflatable packaging structure within which an article and particularly an article of a fragile or delicate nature may be disposed for transportation thereof.

It is frequently necessary for fragile or delicate articles such as items of ceramic ware to be transported by, for example, being mailed from a supplier to a customer, and as will be appreciated it is necessary that each article be disposed within a packaging structure in order to ensure with at least reasonable certainty that the article is not broken or otherwise damaged by the frequently rough handling to which the article may be subjected during the transportation thereof. There has hitherto been proposed and used a wide variety of packaging structures for use in transporting articles and particularly fragile or delicate articles, many of these hitherto known and used packaging structures being inflatable in order to provide the required protection for the articles during transportation. It is, however, a disadvantage of all such hitherto known and used inflatable packaging structures of which the applicants are aware that if, during the transportation of an article therein, the inflatable structure is punctured the protection provided for the article by the inflatable structure is thereby lost either in its entirety, or at least for an entire side or sides of the article.

It is accordingly a primary object of the present invention to provide an inflatable packaging structure in which the above-described disadvantage is substantially reduced but which is nevertheless of relatively light weight and of simple and inexpensive construction. In this connection, it will be appreciated that in many cases the article to be transported, although fragile or delicate, is not of high value, and for the transportation of such articles it is clearly commercially important that the packaging structures be relatively inexpensive.

An inflatable packaging structure according to the present invention comprises an envelope, and an inner liner disposed within the envelope. The inner liner comprises first and second superposed inflatable layers between which an article to be packaged is adapted to be disposed and each of which comprises two inflatable zones each incorporating a plurality of inflatable cells, with the cells of one of the inflatable zones alternating with the cells of the other inflatable zone. A barrier of serpentine configuration separates the two inflatable zones of each inflatable layer and defines the alternating cells of the two inflatable zones. Closable valve means communicates with the zones for admission thereto of pressurized gaseous fluid to inflate the inflatable zones of the first and second inflatable layers.

Figure 1:
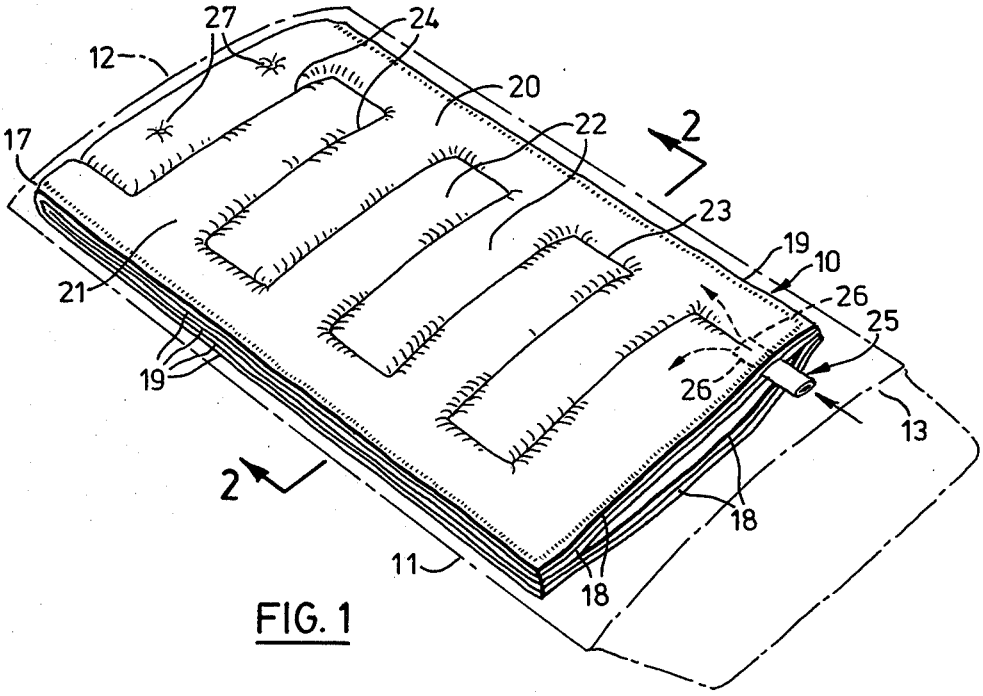
Figure 2:
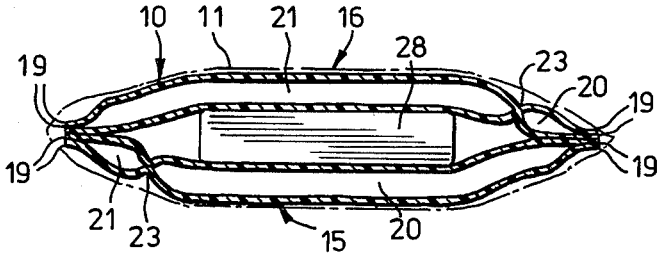

In order that the invention may be more clearly understood and more readily carried into effect the same will now, by way of example, be more fully described with reference to the accompanying drawing in which FIG. 1 is a view of an inflatable packaging structure according to a preferred embodiment of the invention; and FIG. 2 is a sectioned view on the line 2—2 in FIG. 1.

Referring to the drawing, 10 denotes generally an inner liner which is disposed within an envelope 11. The envelope 11 which in the drawing is shown in chain-dotted outline may be of conventional form having a closed end 12 and an opposed end 13 closable by, for example, an adhesively securable flap 14. The inner liner 10 comprises a first or lower inflatable layer 15 and a second or upper inflatable layer 16 superposed on the layer 15, the layers 15, 16 preferably being constituted by a single inflatable layer which has been folded upon itself about a fold 17. Furthermore, the layers 15, 16 are preferably together formed of two superposed flexible sheets of heat-sealable plastics material, the overlying end edge portions 18 of the sheets of plastics material being sealed together preferably by heat sealing, and thereafter the single layer being folded about the fold 17, with the overlying portions of each free longitudinal edge portion 19 of each sheet then being sealed by, for example, heat sealing to the overlying portions of the respective free longitudinal edge portion 19 of the other sheet so that the edge portions 19 of the layer 15 are sealed together, the edge portions 19 of the layer 16 are sealed together, and these edge portions 19 of both layers 15 and 16 are sealed together.

Each layer 15, 16 comprises two inflatable zones 20, 21 with each of these zones 20, 21 incorporating elongated inflatable cells 22, the cells 22 of the zone 20 alternating with the cells 22 of the zone 21, as is clearly shown in FIG. 1. These zones 20, 21 are separated by a barrier 23 which is of serpentine configuraton, as is apparent in FIG. 1, and which defines the alternating cells 22 of the zones 20, 21 the barrier 23 preferably being provided by heat sealing together the superposed sheets of plastics material before the layer is folded about the fold 17. It will be noted that in the preferred embodiment of the invention the zones 20 of the layers 15, 16 are in communication across the fold 17 and thus constitute a single zone 20, and likewise the zones 21 of the layers 15, 16 are in communication across the fold 17 and together constitute a single zone 21, the barrier 23 preferably including transversely disposed portions 24 with the fold 17 extending along one of these portions 24.

Closable valve means is mounted in communication with the zones 20, 21 of the layers 15, 16 for the admission thereto of pressurized gaseous fluid to inflate these zones 20, 21, this valve means preferably comprising a single valve 25 which is mounted between the end edge portions 18 of the layer 16, or alternatively between the end edge portions 18 of the layer 15, prior to the sealing together of these end edge portions 18 of the layer 16, or of the layer 15. The valve is preferably of flexible plastics material and has a bifurcated outlet end portion the limbs 26 of which are separated by, for example, heat sealing with one of the limbs 26 communicating with the zone 20 and the other of the limbs 26 communicating with the zone 21, as indicated by the arrows in FIG. 1.

The inner liner 10 may be attached as indicated by the reference numeral 27 to the envelope 11 preferably at or adjacent to the closed end 12 of the envelope 11.

The inflatable packaging structure of the present invention is thus of light weight, simple and inexpensive construction, and when the inflatable packaging structure is to be used a fragile or delicate article 28 (FIG. 2) to be transported is disposed between the inflatable layers 15, 16 while these layers 15, 16 are in an uninflated condition, the end edge portions 18 of the layer 15 not, of course, being secured to the end edge portions 18 of the layer 16 so that the article 28 may readily be disposed therebetween. Thereafter, the layers 15, 16 are inflated by supplying pressurized gaseous fluid such as air through the valve 25 into the zones 20, 21. This results in the article 28 being securely restrained in a cushioned manner between the inflatable layers 15 and 16, the valve 25 then being closed by the pressure of the air within the zones 20, 21 flattening or collapsing the limbs 26. The end 13 of the envelope 11 is thereafter closed by the flap 14 in the conventional manner, so that the inflated packaging structure is ready for transportation with risk of breakage or other damage to the fragile or delicate article 28 being substantially minimized. If during the transportation of the inflated packaging structure with the article 28 therein one or other of the inflated zones 20, 21 is punctured this will, of course, result in the punctured zone 20 or 21 being deflated, but in view of the alternating relationship of the cells 22 of the zones 20, 21 there will be no substantial reduction in the protection provided for all the sides of the article 28, unless of course both zones 20, 21 are punctured which is a much less likely occurrence.

When the inflated packaging structure reaches its destination the zones 20, 21 may be deliberately punctured, thereby to deflate the layers 15 and 16 and permit ready removal of the article 28 after the envelope 11 has been opened.

While in the preferred embodiment hereinbefore described with reference to the accompanying drawing the inner liner 10 comprises only the first and second layers 15, 16, it will be understood that in alternative embodiments (not shown) the liner 10 may comprise more than two layers corresponding to the layers 15, 16 by disposing the liner 10 in a serpentine configuration having a plurality of folds corresponding to the fold 17.

We claim:

1. An inflatable packaging structure comprising an envelope, and an inner liner disposed within the envelope, the inner liner comprising first and second superposed inflatable layers between which an article to be packaged is adapted to be disposed and each of which comprises two inflatable zones each incorporating a plurality of inflatable cells with the cells of one of the inflatable zones alternating with the cells of the other inflatable zone, a barrier of serpentine configuration separating the two inflatable zones of each inflatable layer and defining said alternating cells of said two inflatable zones, and closable valve means communicating with the zones for admission thereto of pressurized gaseous fluid to inflate the inflatable zones of the first and second inflatable layers.

2. an inflatable packaging structure according to claim 1, wherein the first and second inflatable layers each comprise two superposed portions of flexible sheet plastics material.

3. An inflatable packaging structure according to claim 1, wherein said first and second inflatable layers comprise a single inflatable layer folded upon itself, each inflatable zone of said first inflatable layer being in communication across the fold with a respective one of the inflatable zones of the second inflatable layer.

4. An inflatable packaging structure according to claim 3, wherein portions of the barrier of serpentine configuration are transversely disposed, said fold extending along one of said portions of the barrier.

5. An inflatable packaging structure according to claim 3, wherein each of said first and second inflatable layers has opposed side edges, with the side edges of the first inflatable layer each being secured to a respective one of the side edges of the second inflatable layer.

6. An inflatable packaging structure according to claim 3, wherein the valve means comprises a single valve in communication with each of the inflatable zones of the first and second inflatable layers.

7. An inflatable packaging structure according to claim 6, wherein the valve means is of flexible material and has a bifurcated outlet end portion the limbs of which are each in communication with a respective one of the inflatable zones of the first and second inflatable layers thereby to provide said communication with each of said inflatable zones, the limbs being collapsible to close the valve means by pressure of pressurized fluid within the respective inflatable zones.

8. An inflatable packaging structure according to claim 1, wherein the inner liner is attached to the envelope.

9. An inflatable packaging structure according to claim 8, wherein the envelope has a closed end and an opposed closable end, said attachment of the inner liner to the envelope being at or adjacent to said closed end thereof.

* * * * *